United States Patent [19]

Jäger et al.

[11] 4,395,862

[45] Aug. 2, 1983

[54] COMPOSITE FRAME, PARTICULARLY FOR WINDOWS, DOORS AND FACADES

[75] Inventors: Tilo Jäger, Bielefeld; Siegfried Habicht, Leopoldshöne; Eitel-Friedrich Höcker, Bielefeld, all of Fed. Rep. of Germany

[73] Assignee: Schuco Heinz Schürmann GmbH & Co., Bielefeld, Fed. Rep. of Germany

[21] Appl. No.: 186,562

[22] Filed: Sep. 12, 1980

[30] Foreign Application Priority Data

Sep. 15, 1979 [DE] Fed. Rep. of Germany ..... 2937454

[51] Int. Cl.[3] ..... E04B 1/62

[52] U.S. Cl. ..... 52/731; 52/403; 49/DIG. 1

[58] Field of Search ..... 52/731, 235, 309.13, 52/309.16, 730, 732, 403, 586, 593, 177, 736; 49/DIG. 1, DIG. 2; 403/319, 315, 355

[56] References Cited

U.S. PATENT DOCUMENTS

| | | | |
|---|---|---|---|
| 2,473,728 | 6/1949 | Rutledge | 403/355 |
| 3,535,204 | 10/1970 | Truxa | 52/586 |
| 4,096,678 | 6/1978 | Diels et al. | 52/731 |

*Primary Examiner*—John E. Murtagh
*Assistant Examiner*—Michael Safavi
*Attorney, Agent, or Firm*—Michael J. Striker

[57] ABSTRACT

A composite frame particularly for windows, doors or the like is composed of two metal sub-frames spaced apart from each other. Each of the sub-frame is formed with outwardly extending flanges to define the respective recesses therebetween. A pair of elongated insulating members are inserted into said respective recesses to interconnect the sub-frames to each other. The insulating members are provided with grooves of circular shape to receive the outwardly extending flanges which are deformed to engage the insulating members. At least one elongated gripping element is provided in the assembly which is inserted into a recess formed in each insulating member; the gripping element bears against the respective one of the outwardly extending flanges thereby increasing the coefficient of friction of the insulating member relative to the metal sub-frames.

A method of inserting the gripping element which may be made of wire or of elastic cord is disclosed in the application, which gripping element is placed into the respective recess provided in the insulating member.

5 Claims, 12 Drawing Figures

Fig. 3
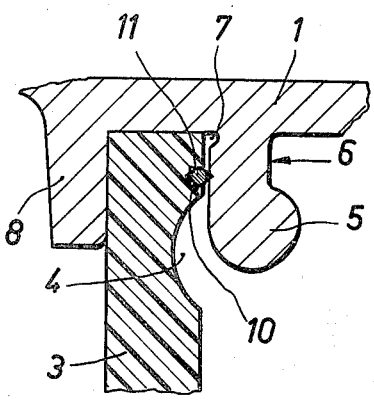
Fig. 4
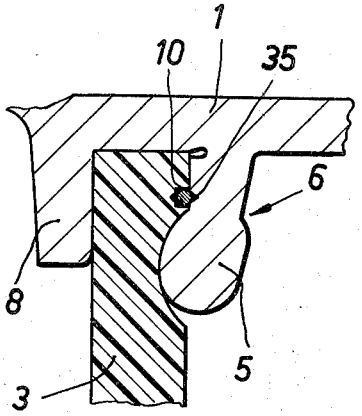
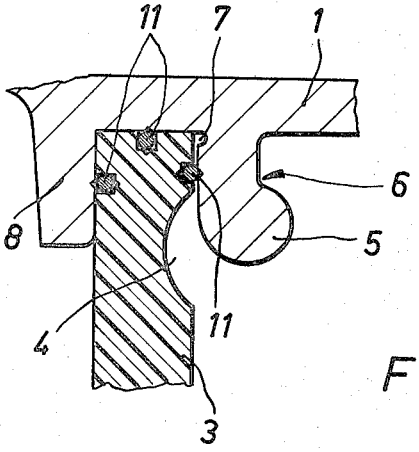
Fig. 5

Fig.11
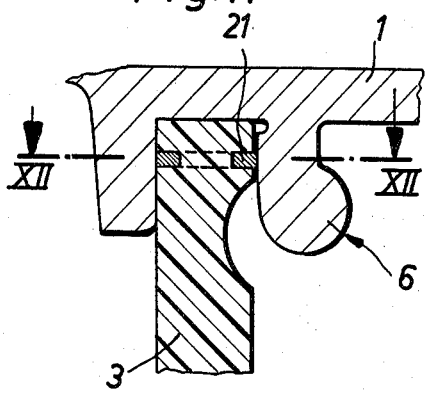
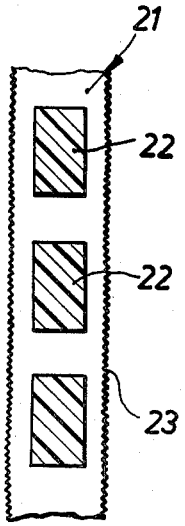
Fig.12
Fig.9
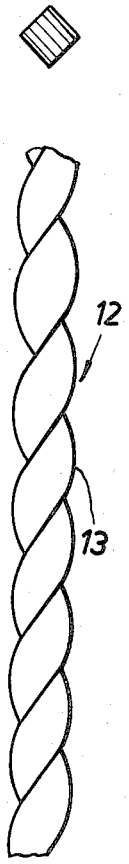
Fig.10

COMPOSITE FRAME, PARTICULARLY FOR WINDOWS, DOORS AND FACADES

BACKGROUND OF THE INVENTION

The invention relates to a composite frame, particularly for use in windows, doors and facades.

Conventional composite frames, as they are commonly known include two metal sub-frames spaced one from another and interconnected by means of an elongated thermally insulated bar inserted into the grooves formed in the sub-frames.

In a previously known frame of this type, (for example disclosed in German Published Application No. 25 52 700), an elongated thermal insulator is made of a plastic material and provided with a special coating to increase the coefficient of friction relative to the metal frames. The coating may comprise a resilient sealing material including additives to increase the coefficient of friction; the additives, for example, may be formed of a fine-grained mineral such as quartz or corundum.

It has been further proposed in German Published Application No. 25 52 700 to provide depressions in the insulator, the depressions being distributed along the length of the insulator in the region where the flanges of the metal sub-frames forming the grooves are to be fixed. Parts of such flanges of the metal sub-frames are deformed into these depressions of the insulator when the sub-frames and insulator are joined together.

The composite frame is provided with good shearing strength by these known measures.

However, it is still desirable to strengthen the composite frames which are composed of relatively light material subjected to deflections when the assembled frame is under loads.

SUMMARY OF THE INVENTION

It is therefore an object of the invention to provide an improved construction of a composite frame utilized in windows, doors or the like which is sufficiently strong and light.

Another object of the invention is to provide a construction of a composite frame of maximum simplicity, efficiency, economy and ease of assembly.

These and other objects of the invention are attained by a composite frame, particularly for windows, doors or the like; comprising two metal sub-frames spaced apart from each other, a pair of elongated insulating members mounting between said sub-frames to interconnect said sub-frames to each other, said sub-frames being provided with outwardly extended portions, the insulating members being formed with respective grooves to receive said portions when the latter are plastically deformed into said grooves thereby engaging said grooves, and a plurality of gripping elements, each located in the respective insulating member in the region of engagement of the same with the respective portion of said sub-frame to thereby increase the coefficient of friction of said insulating member relative to said metal sub-frames.

Each of the insulating members may be formed with an elongated recess at the edge portion thereof to receive the respective one of said gripping elements.

Each of the gripping elements may be a metal elongated member.

This metal may be either a wire or a strip. Said wire may be formed with anchoring teeth extending outwardly from the axis of said wire and provided at two opposite sides of the wire, said teeth extending along the length of the wire. The strip may also be formed with anchoring teeth provided at each opposite side thereof along the length of the strip.

Each of the gripping elements may be formed as an elongated member of elastic material having a cross-section larger than the cross-section of the recess provided in the insulating member.

This member may be made of a synthetic plastic material or of rubber.

The elongated member may also be a cord of elastic material or as a rounded cord of vulcanizable material. The metal elongated member may be made of a light metal which is stronger than the metal of said sub-frames.

The gripping element located in the recess formed in the insulating member bears against the respective one of said outwardly extended portions of the respective sub-frame.

The strip may have a square cross-section, and may be twisted to form a helical coil.

The strip may be perforated.

The objects of the invention are also attained by a method of manufacturing a composite frame for use in windows or the like having two metal sub-frames spaced apart from each other, a pair of elongated insulating members mounted between the sub-frames to interconnect said sub-frames to each other, which sub-frames being provided with outwardly extending portions, and said insulating members having respective grooves for receiving said portions and respective recesses formed at at least one edge portion thereof, which method comprises the steps of providing elongated portions of a rounded cord of vulcanisable material, inserting said elongated portions in the respective recess of the respective one of said insulating members, placing said insulating members between said sub-frames, deforming said outwardly extending portions of said sub-frames into said respective grooves of said insulating members so that said portions when plastically deformed engage said insulating members, and subjecting the assembled frame to heat surface treatment so that said elongated portions of said rounded cord are fully vulcanized by heat generated by said surface treatment.

A method of manufacturing a composite frame is also proposed herein, which composite frame has two metal sub-frames spaced apart from each other, a pair of elongated insulating members mounted between the sub-frames to interconnect said sub-frames to each other, which sub-frames being provided with outwardly extending portions and said insulating members having respective grooves for receiving said portions and respective recesses formed at at least one of the edge portions thereof, which method comprises the steps of extruding of one of insulating members in an extruder, advancing said insulating member, supplying a metal wire from a supply roll and feeding said wire toward the advancing insulating member, milling a plurality of anchoring teeth at at least one side of said wire before the same reaches said insulating member, and inserting said wire into the respective recess of said insulating member.

The feeding step may be performed by means of two guiding rollers, one of said guiding rollers being a milling roller to form said teeth on one side of said wire.

The inserting step may be performed by means of a pressure roller, said pressure roller being a milling roller to form said teeth on the other side of said wire.

The milling step may also be performed by two milling rollers to provide the teeth at both sides of the wire.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 shows an enlarged partial sectional view indicated at III in FIG. 1;

FIG. 4 is an enlarged partial sectional view indicated at IV in FIG. 2;

FIG. 5 is a fragmentary cross-section through a modified composite frame according to the invention;

FIG. 9 shows the cross-section of a wire of a modified construction;

FIG. 10 shows the final shape of a gripping member made of a wire shown in FIG. 9;

FIG. 11 is a partial sectional view through a composite frame in accordance with another embodiment of the invention; and FIG. 12 is a partial sectional view, taken on line XII—XII of FIG. 11.

DETAILED DESCRIPTION OF PREFERRED EMBODIMENTS

Figure 1:
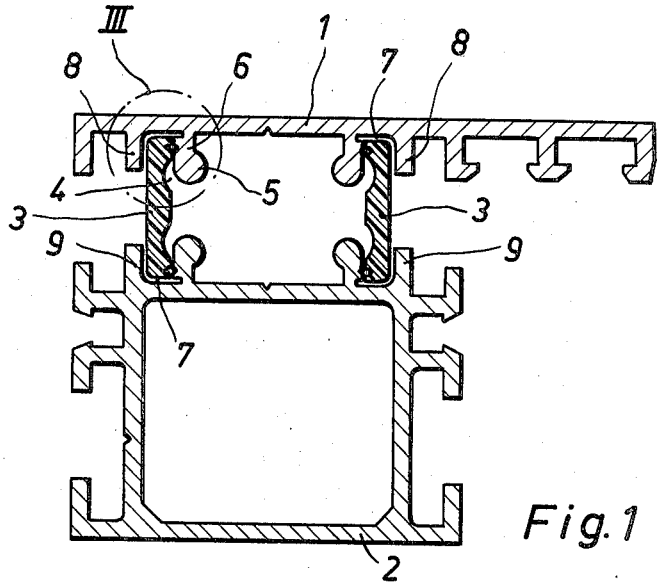
FIG. 1 is a cross-section through a composite frame according to the invention, shown at the intermediate stage of manufacture.
Figure 2:
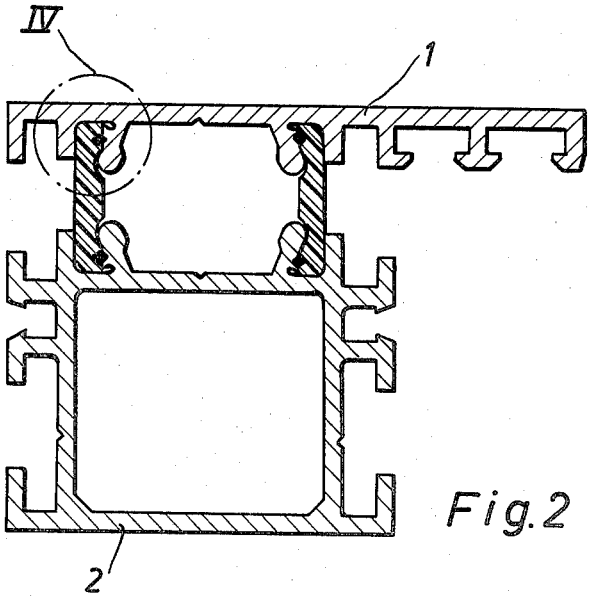
FIG. 2 shows a finished composite frame according to the invention.

A composite frame shown in FIGS. 1 and 2 comprises two metal sub-frames 1, 2 spaced one from another and two elongated insulating elements 3 mounted to interconnect the sub-frames one to another.

Each of the sub-frames 1, 2 is formed with outwardly projecting flanges 6 each of which constitutes with an outwardly projecting extension 8 or 9 horizontally spaced from the flange 6 a respective recess 7. In assembly, the recesses 7 serve to receive the respective ends of the elongated insulators 3. Each flange 6 has a shape of a bead and arranged in assembly to extent into a respective groove 4 provided in the elongated insulating element 3. Two vertically spaced from each other circular grooves 4 are formed in each insulating element 3 to receive beaded edges 5 of flanges 6 deformed into these recesses to connect the sub-frames 1 and 2 to each other.

The insulating elements 3, which are made of a plastics material, are dimensionally stable and strong enough to maintain their cross-sectional shape either completely or at least substantially, when their beaded edges 5 are deformed into the grooves 4.

FIGS. 3 and 4 further show that recesses 10 are provided in the edge portion of the insulating elements 3 received in the recesses 7. The recesses 10 are formed when the insulating elements are extruded as will be explained below. Recesses 10 extend over their whole length. The purpose of the grooves 10 is to receive an elongated gripping member in the form of a wire 11. The wire 11 may, for example be made of a light metal, which however should be stronger than the metal of sub-frames 1 and 2, which are also made of a light metal. The recess 10 formed in the insulating element 3 opens towards the flange 6 of the respective sub-frame. The wire 11 is provided with anchoring projections 35 outwardly extended from the body of the wire, which projections may be formed by cutting teeth or milling cutouts made at the side facing towards the flange 6 and at the opposite side of the wire. When the flange 6 is molded or deformed into the groove 4 (or from the position shown in FIG. 3 to the position shown in FIG. 4) the opposite projections 35 extend into the material of the flange 6 and into the material of the insulating element 3. This increases the shearing strength between the metal sub-frames 1, 2 and the insulating elements 3.

The wire 11 may be of generally circular section (FIGS. 3–5), but it also may be a metal strip of different cross-sections, for example of rectangular shape as shown in FIG. 9, or a twisted wire 12 constructed as shown in FIG. 10.

The wire 12 shown in FIG. 20 has a shape of helically twisted wires to form coils 13. When the flange 6 is molded into the respective recess 4, the coils 13 engage into the flange 6 at the location where they project from the recess 10. The coils 13 also establish a frictional connection with the insulating elements 3.

As may be seen from FIG. 5, the insulating element may be provided with a plurality of recesses 10 each formed at a different side of the insulating element to receive a plurality of wires 11 or 12, where the edge portions of the insulating element engage the recess 7 of the metal sub-frame 1 or 2, respectively.

Figure 6:
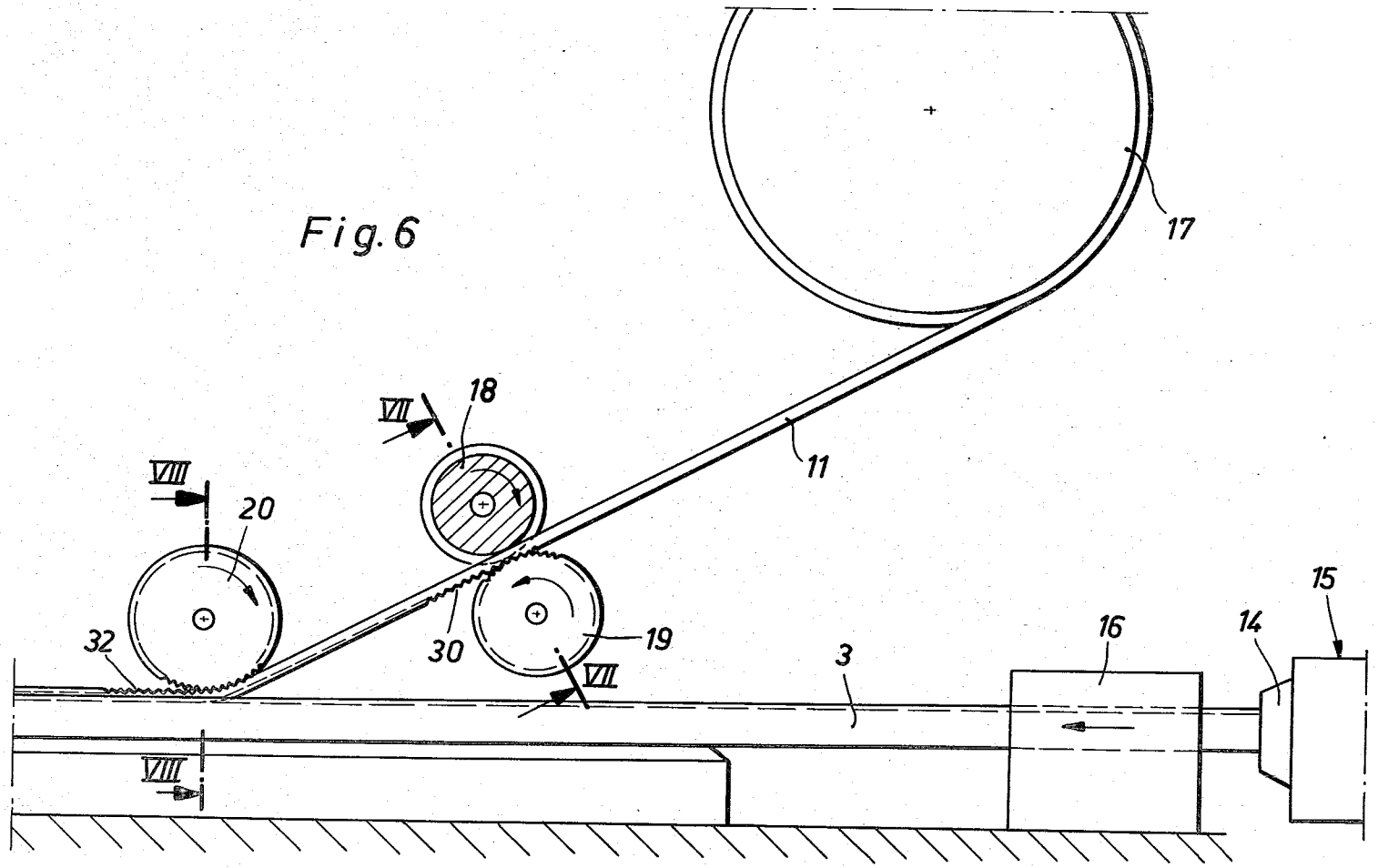
FIG. 6 is a diagrammatic view of an apparatus for the manufacture of an elongated insulator for a composite frame according to the invention together with an arrangement for insertion of an elongated gripping member into a receiving groove provided in the insulator.
Figure 7:
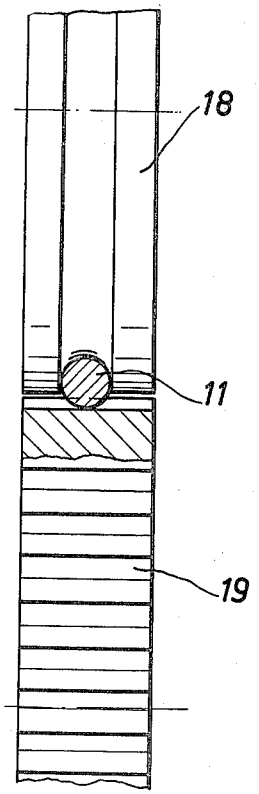
FIG. 7 shows a partial sectional view taken along line VII—VII of FIG. 6.
Figure 8:
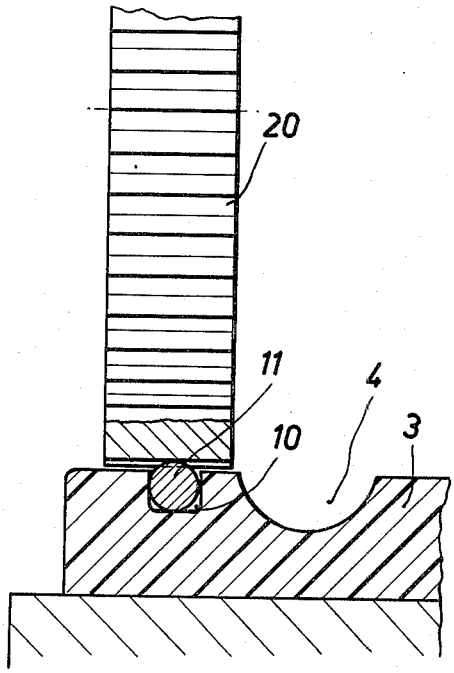
FIG. 8 is a partial sectional view taken along line VIII—VIII of FIG. 6.

An apparatus for inserting a wire into a recess 10 of the insulating element is illustrated diagrammatically in FIGS. 6, 7 and 8. The insulating element 3 is discharged from a head 14 of an extruder 15 and first passes through a calibrating arrangement 16 from which it is further advanced toward a pressure roller 20. A wire 11 is pulled off a supply roll 17 and is fed thereafter through a pair of rollers 18 and 19 of which roller 18 is a guiding roller and roller 19 is a milling roller. As the wire 11 passes through this pair of rollers it is milled at the underside thereof so that the outwardly extending projections 30 are formed thereon. The wire 11 is then advanced towards the pressure roller 20. A pressure roller 20 not only inserts the wires 11 into the recess 10 of the insulator as may be clearly seen in FIG. 6, which grooves were prefabricated in the extruder 15 but also forms outwardly extending projections 32 on the upper side of the wire 11 since the pressure roller 20 is provided with teeth at its periphery. The projections 32 are formed at the side of the wire 11 opposite to the side having projections 30.

The wire 11 unwound from the supply roll 17 may alternatively pass through a pair of milling rollers, by which the projections 30 and 32 are made on two opposite sides. The wire 11 is then inserted into the receiving groove of the insulator 3 by the pressure roller 20.

In the example illustrated in FIGS. 11 and 12, a perforated strip of metal 21 is extruded simultaneously with the insulator, holes 22 in the strip of metal being filled with the plastics material of the insulating element. The perforated sheet of metal 21 is provided with teeth 23 formed along its longitudinal edges. The metal strip 21 is made of metal harder than the metal of sub-frames 1 and 2. The teeth 23 extend beyond the lateral boundary surfaces of the insulating element 3, so that when the flange 6 of the metal sub-frame is deformed to engage the insulator 2, the teeth 23 extend into the metal sub-frames 1 and 2, respectively, and establish a frictional connection between the insulating element and the sub-frame 1 or 2.

The elongated gripping member which was disclosed herein as a wire or an elongated member with anchoring teeth or cutting edges which extend into the respective beaded portion of the metal sub-frame may have different modified constructions.

The gripping member may be formed as a resilient elongated member of rubber or synthetic plastic material which has a cross-section larger than the cross-section of the receiving recess 10.

The gripping member may also be formed of a flexible cord of elastic material.

The gripping member may be made of a rounded cord of vulcanisable material to be joined with the insulating element and the respective metal sub-frame before the complete vulcanization takes place.

When the gripping member inserted into the recess 10 of the insulating member 3 is made of synthetic plastic material or rubber and has a cross-section which is larger than the cross-section of the receiving groove, a metal sub-frame is joined to the insulating member with inevitable deformation of the metal flange 6, the elongated gripping member is elastically deformed, so that it exerts a returning force on the joined components and increases the shearing strength between the sub-frame and the insulating member by this frictional connection.

If the receiving groove of the insulating member is provided with an elongated gripping cord of a vulcanisable material, and the metal sub-frame is joined to the insulating member by deformation of metal flanges, the composite frame is subjected to surface treatment at elevated temperatures—such as eloxadising, coating or the like—so that the rounded cord is fully vulcanised and additional adhesion between the components to be joined is obtained to increase the shearing strength between these components.

It will be understood that each of the elements described above, or two or more together, may also find a useful application in other types of composite frame, particularly for windows, doors and facades differing from the types described above.

While the invention has been illustrated and described as embodied in a composite frame, particularly for windows, doors and facades, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A composite frame, particularly for windows, doors or the like, comprising two metal sub-frames spaced apart from each other; a pair of elongated insulating members mounted between said sub-frames and connecting said sub-frames to each other, said sub-frames being provided with outwardly extended portions, said insulating members being formed with respective grooves which receive said portions, said portions being plastically deformed into said grooves thereby engaging said grooves; and a plurality of elongated gripping elements, each located in the respective insulating member in the region of engagement of the same with said respective portion of said sub-frame to thereby increase the coefficient of friction of said insulating member relative to said metal sub-frames, each of said insulating members being formed with an elongated recess at an edge portion thereof to receive the respective one of said elongated gripping elements, said elongated gripping elements being each formed with anchoring teeth provided at two opposite sides thereof and extending along the length of the gripping element, and each of said gripping elements being a wire, said teeth extending outwardly from the axis of said wire.

2. The frame of claim 1, wherein each of said elongated gripping elements is made of a light metal which is stronger than the metal of said sub-frames.

3. The frame of claim 1, wherein each of said gripping elements located in said elongated recess bears against the respective one of said outwardly extended portions of the respective sub-frame.

4. A composite frame, particularly for windows, doors or the like, comprising two metal sub-frames spaced apart from each other; a pair of elongated insulating members mounted between said sub-frames and connecting said sub-frames to each other, said sub-frames being provided with outwardly extended portions, said insulating members being formed with respective grooves which receive said portions, said portions being plastically deformed into said grooves thereby engaging said grooves; and a plurality of elongated gripping elements, each located in the respective insulating member in the region of engagement of the same with said respective portion of saidframe to thereby increase the coefficient of friction of said insulating member relative to said metal sub-frames, each of said insulating members being formed with an elongated recess at an edge portion thereof to receive the respective one of said elongated gripping elements being each formed with anchoring teeth provided at two opposite sides thereof and extending along the length of the gripping element, each of said gripping elements being a metal strip, said strip having a square cross-section and being twisted to form a helical coil.

5. The frame of claim 4, wherein said strip is perforated.

* * * * *